United States Patent [19]

Cheng

[11] Patent Number: 4,836,690

[45] Date of Patent: Jun. 6, 1989

[54] CARRIER CONTAINER WITH IMPROVED CLOSURE

[76] Inventor: Peter S. C. Cheng, 5 Ross Street, Toronto, Ontario, Canada, M5T 1Z8

[21] Appl. No.: 199,753

[22] Filed: May 27, 1988

[51] Int. Cl.[4] ..... B65D 33/06; B65D 33/16

[52] U.S. Cl. ..... 383/6; 383/42; 383/68; 383/62; 383/98

[58] Field of Search ..... 383/6, 68, 8, 61, 62, 383/78, 98, 120, 30, 31, 42; 220/334, 340; 150/123, 118

[56] References Cited

U.S. PATENT DOCUMENTS

| | | | |
|---|---|---|---|
| 875,224 | 12/1907 | Underwood | 383/30 |
| 3,199,766 | 8/1965 | Vineberg | 383/10 |
| 3,349,992 | 10/1967 | Skinner | 383/26 |
| 3,447,737 | 6/1969 | Mahr | 383/10 |
| 3,455,359 | 7/1969 | Schweizer | 383/61 |
| 3,727,830 | 4/1973 | Harrison | 383/30 |
| 3,977,596 | 8/1976 | Gamble | 383/10 |

FOREIGN PATENT DOCUMENTS

| | | | |
|---|---|---|---|
| 1464013 | 11/1966 | France | 383/6 |

*Primary Examiner*—Willis Little

*Attorney, Agent, or Firm*—Kirschstein, Kirschstein, Ottinger & Israel

[57] ABSTRACT

A bag is converted into a box by overlapping flaps. The box is maintained in a closed position by closure members movable to a closed position in which the closure members overlap and maintain the flaps in overlapping state.

15 Claims, 3 Drawing Sheets

FIG. 1
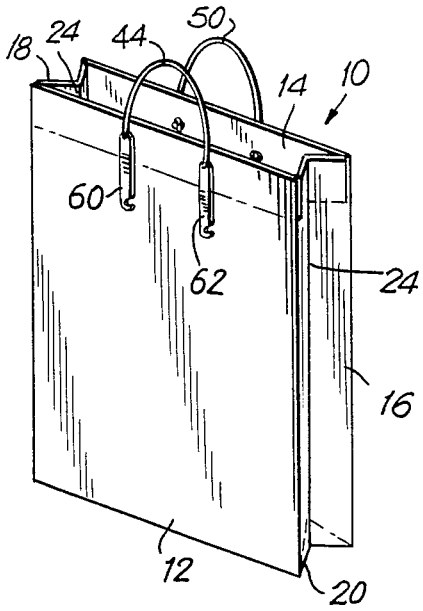
FIG. 2
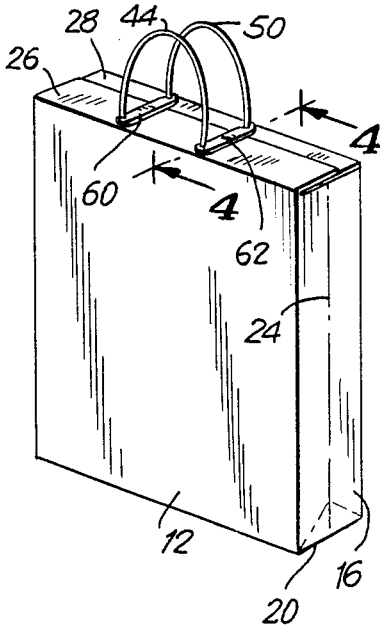
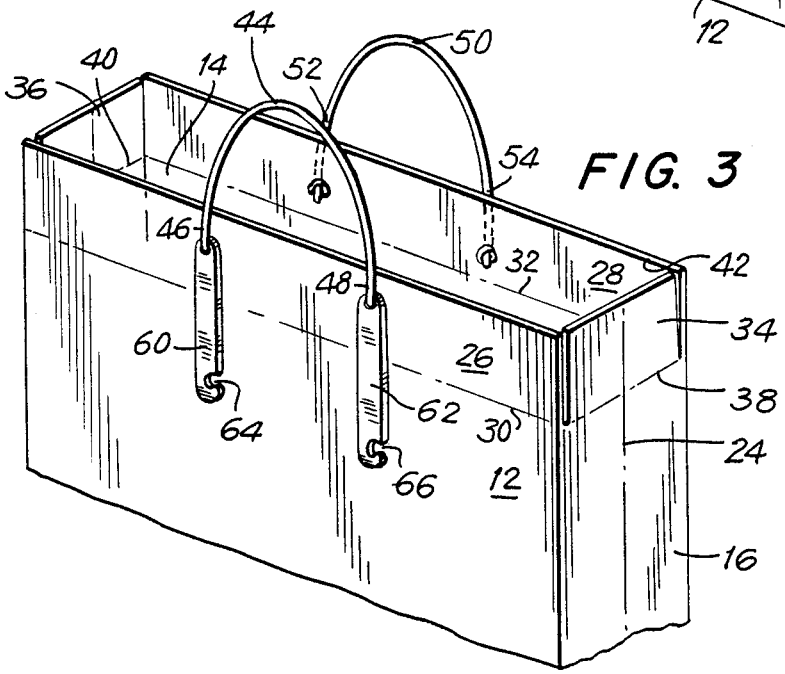
FIG. 3

FIG. 4
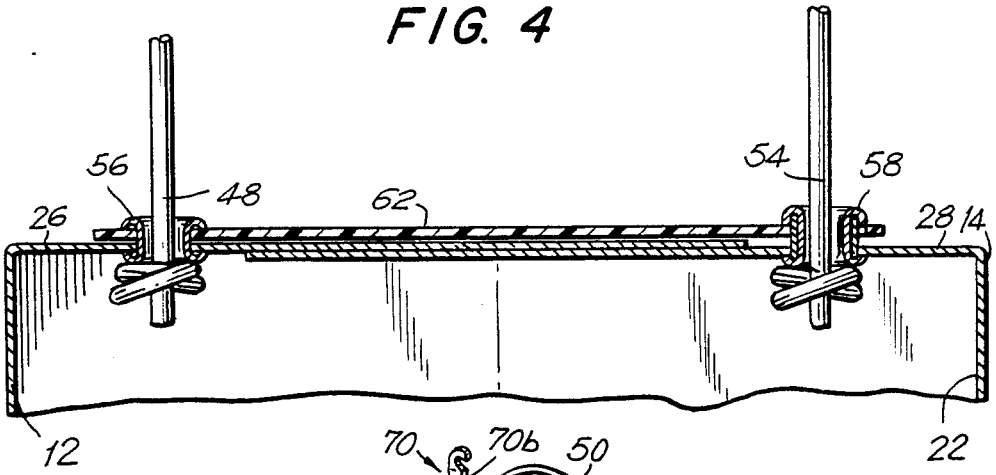
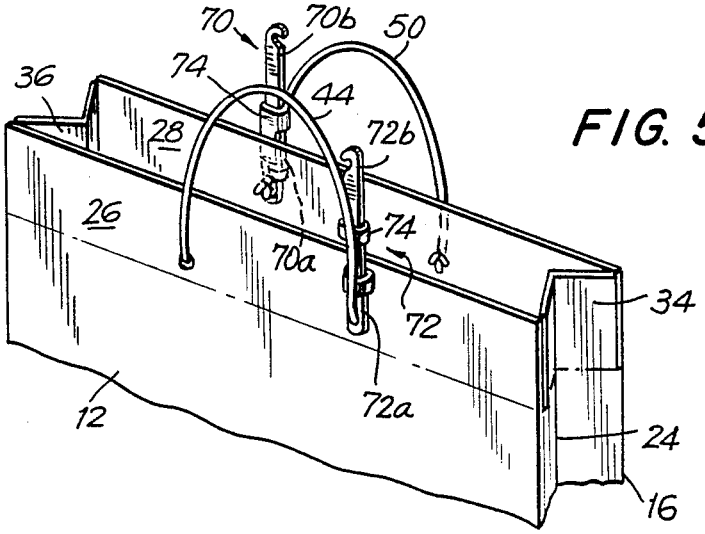
FIG. 5
FIG. 6
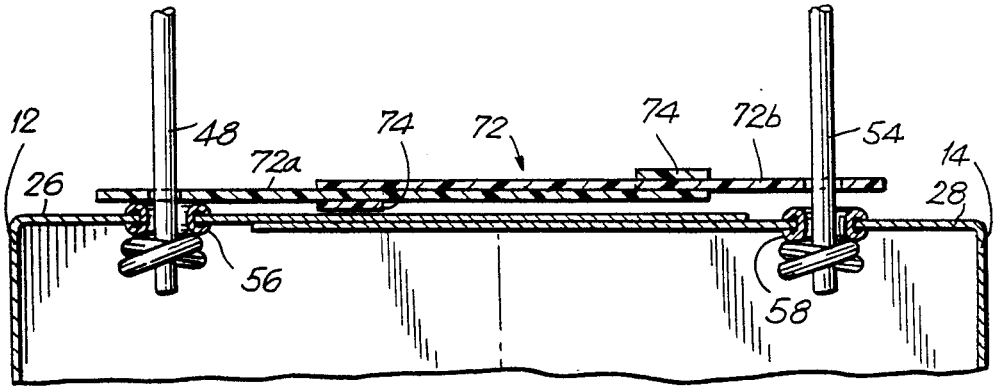

CARRIER CONTAINER WITH IMPROVED CLOSURE

BACKGROUND OF THE INVENTION

1. Field of the Invention

This invention generally relates to carrier bags that are convertible to boxes and, more particularly, to closures for effectively maintaining the bags closed during carrying of objects placed within the bags.

2. Description of Related Art

It is known to convert a bag composed of paper or like sheet material into a box of parallelepiped shape by folding upper marginal portions or flaps of the bag inwardly over the open mouth of the bag and into mutual overlapping engagement so as to close the bag mouth. To maintain the bags closed, it is known, for example, from U.S. Pat. No. 2,992,768 and 3,447,736, to frictionally retain a string carrying handle in slits formed in the overlapping flaps. It is also known, from U.S. Pat. No. 2,532,778, to use snap fasteners. It is further known,from U.S. Pat. No. 875,224, to employ bendable tongues to keep overlapping box flaps together.

Although generally satisfactory for their intended purposes, the known containers in which bags are convertible into boxes have not proven to be altogether effective in maintaining the box closed under the weight of an object to be carried in the box. Experience has shown that some objects, particularly of heavy weight, sometimes cause the overlapping flaps to unfold and the box to collapse under the weight of the object. Thus, the aforementioned snap fasteners tend to unsnap; bent-over tongues tend to unbend; and string handles tend to pull out of their slits, when subjected to the weight of heavy objects. The resultant collapsed box with unfolded flaps was very unsightly, particularly when it is appreciated that the top of the box is its most conspicuous part. Also, an open bag was undesirable because it permitted rain, airborne dust and dirt to enter the box.

SUMMARY OF THE INVENTION

1. Objects of the Invention

It is a general object of this invention to overcome the aforementioned drawbacks of carrier containers of the type in which a bag is converted into a box.

It is another object of this invention to effectively close a box formed from a bag during use.

Still another object of this invention is to provide a shopping bag which is easily convertible to a box.

2. Features of the Invention

In keeping with these objects, and others which will become apparent hereinafter, one feature of this invention resides, briefly stated, in a carrier container comprising a bag, a pair of carrying handles, and closure means. The bag has an open mouth, a closed bottom, and front, rear and end panels bounding an interior for receiving an object to be carried. The front and rear panels are spaced apart of each other along a transverse direction. The front and rear panels,respectively, have front and rear upper marginal portions or flaps at the mouth. The flaps are foldable toward each other to a folded state to close the mouth and form the bag with a box-like configuration in which the front and rear panels are generally parallel to each other.

In a preferred embodiment, the end panels are spaced apart of each other along a cross direction generally perpendicular to said transverse direction. The end panels also have upper marginal portions or end flaps at the mouth foldable toward each other to a folded state to close the mouth and form a bag with said box-like configuration in which the end panels are generally parallel to each other.

The carrying handles are provided one on each front and rear panel. The handles carry the object and uniformly distribute the weight of the object during carrying.

The closure means maintains the box-like configuration for the bag during carrying. At least one closure member, and preferably two closure members are provided at the mouth. Each closure member is movable to a closed position in which the closure member extends from one carrying handle along said transverse direction to the other carrying handle. Each closure member overlaps and maintains the front and rear flaps, as well as the end flaps, in their respective folded states.

Each closure member is advantageously mounted on one of the carrying handles for swinging movement. Each closure member has a hook for engaging the other of the carrying handles in said closed position. Each closure member is optionally provided with means for adjusting its length to accommodate bags of different depths.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 1 is a front perspective view of a bag shown in a partially-collapsed state;

FIG. 2 is a front perspective view of the bag of FIG. 1 in a box-like configuration;

FIG. 3 is a front perspective,partially broken-away view of the upper portion of the bag of FIG. 1 in a fully-open state;

FIG. 4 is an enlarged sectional view taken on line 4—4 of FIG. 2;

FIG. 5 is a view analogous to FIG. 3, but of a different embodiment of the closure means;

FIG. 6 is an enlarged sectional view analogous to FIG. 4, but of the embodiment of FIG. 5 in the closed state.

DETAILED DESCRIPTION OF THE PREFERRED EMBODIMENTS

Figure 7:
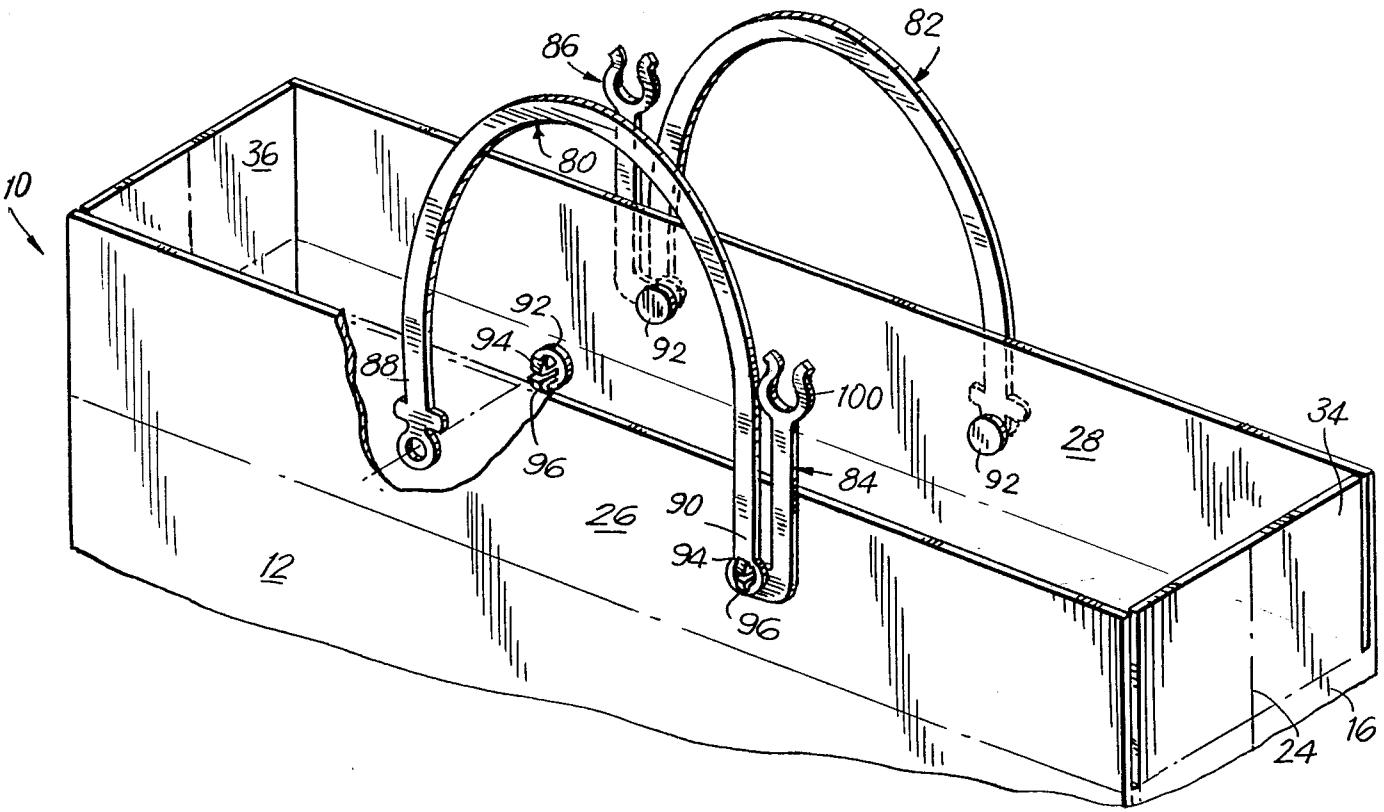
FIG. 7 is a view analogous to FIG. 3 of another embodiment.

Referring now to FIG. 1, reference numeral 10 generally identifies a shopping bag composed of relatively thin sheet material, e.g. paper. Bag 10 has a front panel 12, a rear panel 14, an end panel 16, another end panel 18, and a bottom panel 20. All of said panels bound an interior 22 in which an object, e.g. a gift, is received. Each end panel 16, 18 has upright longitudinal creases 24 dividing each end panel in half. Bag 10 is collapsible by folding the halves of each end panel upon each other, and by moving the creases 24 toward each other, thereby bringing the front and rear panels 12, 14 into mutual surface contact. The bag 10 in FIG. 1 is shown in a partially-collapsed/partially-open state, and the upper part of the bag 10 is shown in a completely open state in FIG. 3.

As best shown in FIG. 3, front and rear panels 12, 14 have upper marginal portions or flaps 26, 28 respectively foldable along horizontal fold lines 30, 32 extending along the width of the bag. End panels 16, 18 have upper marginal portions or flaps 34, 36 respectively foldable along fold lines 38, 40 extending along the depth dimension of the bag. Fold lines 30, 32 extend along a transverse direction which is orthogonal to fold lines 38, 40.

Bag 10 has an open mouth 42 which is closed by folding flaps 34, 36 about fold lines 38, 40 inwardly, and by folding flaps 26, 28 about fold lines 30, 32, also inwardly,over the mouth. The order in which the various flaps are folded is not important, so long as all the flaps are in overlapping relationship after folding to close the mouth 42 as shown in FIG. 2, wherein the front and rear panels 12, 14 are in mutual parallelism, and the end panels 16, 18 are likewise in mutual parallelism, thereby forming a box-like configuration of parallelepiped shape.

A string-type carrying handle 44 having first end regions 46, 48 is mounted on the flap 26. Another string-type carrying handle 50 having second end regions 52, 54 is mounted on the flap 28. Each handle has a generally inverted U-shape. The handles lie in mutually parallel planes, and are used for uniformly distributing the weight of the object placed within bag 10.

Each handle end region passes through a hole furnished in a respective flap 26, 28, and is knotted (see FIG. 4) at its end to prevent the knotted end from pulling out of its respective hole.

A tubular mounting element 56, preferably constituted by a rivet whose opposite ends are peened over, is mounted at each first handle end region 46, 48. The handle end regions 46, 48 pass with a slight clearance through each mounting element 56. A tubular catch element 58, preferably constituted by a rivet whose opposite ends are peened over, is mounted at each second handle end region 52, 54. The handle end regions 52, 54 pass with a slight clearance through each catch element 58. The knot formed at the end of each handle end region has a larger effective crosssection than the peened-over end of the respective elements 56, 58 to prevent the knotted end from passing through the interiors of the elements 56, 58.

In order to maintain the box-like configuration of FIG. 2 for the bag during carrying of an object placed within the interior 22, at least one closure member, and preferably two closure members 60, 62 are provided adjacent the mouth 42. Preferably, the closure members are flat, stamped-out, elongated links, first ends of which are pivotably mounted on the mounting members 56 mounted on flap 26, and opposite second ends of which are provided with hooks 64, 66.

As shown in FIG. 3, the closure members are freely suspended from the first handle end regions 46, 48 in the open-bag position. Thereafter, once the flaps are in mutual overlapping engagement, the closure members are swung over the flaps until the hooks 64, 66 hookingly engage the catch members 58 provided at the second handle end regions 52, 54, respectively. The closure members extend from carrying handle 44 to handle 50 along a transverse direction in a spacedapart, mutually-parallel relationship. The closure members overlap and maintain the flaps in their respective folded states.

As particularly shown in FIG. 4, each catch member 58 has a slightly greater height or length dimension, as compared to each mounting member 56, so as to provide a sufficient spacing for a respective hook to engage the catch member. In the broadest aspect of this invention, the mounting members and catch members can be eliminated, in which case, the closure members would be pivotably mounted directly on the first handle end regions and would hookingly engage directly on the second handle end regions.

As shown in FIG. 5, the closure members need not be of one-piece, but can be of two-piece,construction, in which case, it is advantageous if each closure member comprises two overlapping closure elements whose length of overlap is adjustable so as to accommodate boxes of different depths. Thus, closure members 70, 72 each have two closure elements **70*a*, 70*b*; 72*a*, 72*b*, which overlap in length and which are frictionally retained in any adjusted position by frictional holders 74**.

FIG. 5 also shows that the closure members need not be mounted on one carrying handle and swung over to engage the other carrying handle, but, instead, the closure members can be mounted on different carrying handles.

FIG. 6 also shows that a closure member can be mounted directly on a handle end region and can hookingly engage another handle end region, all without using the aforementioned mounting elements 56 and catch elements 58, in which case, the heights of the mounting and catch elements are the same.

In still another embodiment, the closure members need not be a discrete part, but, instead, can be made of one piece with a respective handle. As shown in FIG. 7, handles 80, 82 are mounted on opposite sides of the bag 10 and, more particularly, on front and rear flaps 26, 28. Each handle 80, 82 includes a one-piece closure member 84, 86.

Representative handle 80 has opposite end portions 88, 90, each formed with a through hole juxtaposed with a through hole formed in the front flap 26. A fastener 92 having a stem 94 and a bulbous enlarged head 96 is inserted through each pair of juxtaposed holes to fasten each end portion 88, 90 to the front flap. An analogous fastening arrangement serves to mount handle 82 on rear flap 28.

Representative closure member 84 is integrally molded with end portion 90 of handle 80 and is movable relative to handle 80 at living hinge 98. A hook or resilient clip 100 at the remote end of closure member 84 engages an end portion of the opposite handle 82 in the closed position. Analogously, closure member 86 engages an end portion of the handle 80 in the closed position.

In another embodiment, the handles and closure members need not be molded of one-piece plastic construction. Indeed, the closure members can be made of many different materials, including folded-over ribbons.

The handles need not necessarily be made of string or cord-type material, or even flat plastic material, but can also be cutouts formed in upper marginal portions of the front and rear panels. The handles can also be formed of ribbons extending around the front, base and rear panels of the bag.

In another approach, the front and rear flaps can be formed with molded-in hooks or analogous fasteners, wherein each hook on one side of the bag engages an opposite handle portion or complementary fastener on the other side of the bag.

It will be understood that each of the elements described above, or two or more together, also may find a useful application in other types of constructions differing from the types described above.

While the invention has been illustrated and described as embodied in a carrier container with improved closure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A carrier container, comprising:

(A) a bag having an open mouth, a closed bottom, and a plurality of panels bounding an interior for receiving an object to be carried, (i) two of said panels being spaced apart of each other along a transverse direction, at least one of said panels having a flap at the mouth manually positionable to a folded state to close the mouth and form the bag with a box-like configuration in which the two panels are generally parallel to each other;

(B) a pair of carrying handles at opposite sides of the bag, for carrying the object, and for uniformly distributing the weight of the object during carrying; and (C) closure means for maintaining the box-like configuration for the bag during carrying, including at least one closure member at the mouth and movable to a closed position in which said one closure member extends from one carrying handle along said transverse direction to the other carrying handle and overlaps, and maintains, said flap in the folded state.

2. The container according to claim 1, wherein said two panels constitute a front and a rear panel, and wherein said plurality of panels include end panels.

3. The container according to claim 2, wherein the end panels are spaced apart of each other along a cross direction generally perpendicular to said transverse direction, said end panels having end flaps at the mouth foldable toward each other to a folded state to close the mouth and form the bag with said box-like configuration in which the end panels are generally parallel to each other; and wherein said one closure member is also operative to maintain the end flaps in their folded state.

4. The container according to claim 1, wherein said one closure member is mounted on one of the carrying handles for swinging movement, and has a hook for engaging the other of the carrying handles in said closed position.

5. The container according to claim 1, wherein each handle has two handle end regions connected to the bag, and wherein said closure means includes two closure members, each mounted on first handle end regions of one of the carrying handles for swinging movement, each closure member having a hook for engaging second handle end regions of the other of the carrying handles in said closed position.

6. The container according to claim 5, wherein a tubular mounting element surrounds each first handle end regions of said one carrying handle, each closure member being mounted on a respective mounting element; and wherein a tubular catch element surrounds each second handle end region of said other carrying handle, each hook being engaged on a respective catch element.

7. The container according to claim 1, wherein said one closure member has a length, and said closure means includes means for adjusting the length of said one closure member.

8. The container according to claim 1, wherein said one closure member is of one-piece construction.

9. The container according to claim 1, wherein said one closure member is of two-piece construction, one piece overlapping and slidably engaging the other piece.

10. The container according to claim 1, wherein each handle has two handle end regions connected to the bag, and wherein said closure means includes two closure members, one closure member being mounted for swinging movement on a handle end region of one of the carrying handles, and having a hook for engaging a handle end region on the other of the carrying handles in the closed position, the other closure member being mounted for swinging movement on a handle end region of the other carrying handle, and having a hook for engaging a handle end region on the one carrying handle in the closed position.

11. The container according to claim 6, wherein a tubular mounting element surrounds each handle end region on which a respective closure member is mounted for swinging movement, and wherein a tubular catch element surrounds each handle end region engaged by a respective closure member.

12. The container according to claim 2, wherein the front and rear panels respectively have front and rear flaps at the mouth and foldable toward each other to said folded state, and wherein the carrying handles are respectively mounted on the front and rear flaps.

13. The container according to claim 12, wherein said closure means includes two closure members respectively mounted on the front and rear panels, said closure members overlapping and maintaining the front and rear flaps in said folded state.

14. The container according to claim 1, wherein said at least one closure member is of one piece with one of the carrying handles.

15. A carrying container, comprising:

(A) a shopping bag having an open mouth, a closed bottom, and front, rear and end panels bounding an interior for receiving an object to be carried, (i) said front and rear panels being spaced apart of each other along a transverse direction and respectively having front and rear flaps at the mouth foldable toward each other to a folded state, (ii) said end panels being spaced apart of each other along a cross direction generally perpendicular to said transverse direction and respectively having end flaps at the mouth foldable toward each other to a folded state, (iii) said front and rear flaps being folded over the end flaps to close the mouth and form the bag with a box-like configuration in which the front and rear panels are generally parallel to each other and in which the end panels are generally parallel to each other;

(B) a pair of carrying handles, one on each front and rear panel, for carrying the object, and for uniformly distributing the weight of the object during carrying; and (C) closure means for maintaining the boxlike configuration for the bag during carrying, including two closure members, each mounted for swinging movement on one of the handles, and having a hook which is movable to a closed position in which each hook engages the other of the handles, each closure member in the closed position extending between the handles along said transverse direction and overlapping, and maintaining, the flaps in their respective folded states.

* * * * *